US005439610A

United States Patent [19]

Ryan et al.

[11] Patent Number: 5,439,610

[45] Date of Patent: Aug. 8, 1995

[54] CARPET CLEANER CONTAINING FLUORINATED SURFACTANT AND STYRENE MALEIC ANHYDRIDE POLYMER

[75] Inventors: Tracy A. Ryan, River Vale; Catherine A. Piterski, Saddle Brook, both of N.J.

[73] Assignee: Reckitt & Colman Inc., Wayne, N.J.

[21] Appl. No.: 308,067

[22] Filed: Sep. 16, 1994

Related U.S. Application Data

[63] Continuation of Ser. No. 139,240, Oct. 19, 1993, abandoned.

[51] Int. Cl.[6] ..... C11D 3/37; C11D 3/60; D06B 1/00; D06M 13/244

[52] U.S. Cl. ..... 252/174.23; 8/137; 252/171; 252/173; 252/174.24; 252/546; 252/550; 252/DIG. 2; 252/DIG. 19

[58] Field of Search ..... 252/174.23, 174.24, 252/DIG. 2, DIG. 19, 171, 173, 546, 550; 8/137

[56] References Cited

U.S. PATENT DOCUMENTS

| | | | |
|---|---|---|---|
| Re. 30,337 | 7/1980 | Loudas | 252/8.75 |
| 2,850,460 | 9/1958 | Ginn et al. | 252/153 |
| 3,723,358 | 3/1973 | Morgan et al. | 252/546 |
| 3,779,929 | 12/1973 | Abler et al. | 252/90 |
| 3,835,071 | 9/1974 | Allen et al. | 252/545 |
| 3,901,727 | 8/1975 | Loudas | 134/4 |
| 4,013,595 | 3/1977 | Podella et al. | 252/545 |
| 4,043,923 | 8/1977 | Loudas | 252/8.75 |
| 4,063,961 | 12/1977 | Howard et al. | 134/4 |
| 4,124,542 | 11/1978 | Devine | 252/546 |
| 4,336,165 | 6/1982 | Weisensel | 252/528 |
| 4,490,270 | 12/1984 | Hackett et al. | 252/106 |
| 4,518,517 | 5/1985 | Eigen et al. | 252/107 |
| 4,556,434 | 12/1985 | Woogerd | 134/22.14 |
| 4,561,991 | 12/1985 | Herbots et al. | 252/118 |
| 4,652,389 | 3/1987 | Moll | 252/90 |
| 4,678,595 | 7/1987 | Malik et al. | 252/174.17 |
| 4,847,004 | 7/1989 | McLeod | 252/527 |
| 4,902,434 | 2/1990 | Dickerson | 252/8.6 |
| 5,284,597 | 2/1994 | Rees | 252/103 |
| 5,338,475 | 8/1994 | Corey et al. | 252/102 |
| 5,370,919 | 12/1994 | Fieuws et al. | 428/96 |

FOREIGN PATENT DOCUMENTS

42875/89 5/1990 Australia .

OTHER PUBLICATIONS

Chemical Abstract Accession No. 84: 19549, "Improved Rug Shampoo," in Research Disclosure (1975), 139, 7 (no month available).

*Primary Examiner*—Paul Lieberman
*Assistant Examiner*—Ardith Hertzog
*Attorney, Agent, or Firm*—Frederick H. Rabin; J. Jeffrey Hawley

[57] ABSTRACT

An aqueous cleaning composition for carpets, rugs, and textiles has been discovered with the composition comprising sodium lauryl sulfate, an ethylene glycol monohexyl ether, a fluorosurfactant, a carboxylated polymer salt, and a tetrasodium ethlyenediamine tetraacetate. The composition is effective in removing a variety of stains from carpeting and is particularly effective against oily stains without imparting undesirable properties on the cleaned surface.

11 Claims, No Drawings

CARPET CLEANER CONTAINING FLUORINATED SURFACTANT AND STYRENE MALEIC ANHYDRIDE POLYMER

CROSS REFERENCE TO RELATED APPLICATIONS

This application is a Continuation of U.S. Ser. No. 08/139,240, filed Oct. 19, 1993, now abandoned.

FIELD OF THE INVENTION

This invention relates to cleaning compositions particularly useful in removing stains from rugs, carpets, and textiles.

BACKGROUND OF THE INVENTION

A wide variety of carpet cleaning and anti-soiling compositions are available for do-it-yourself carpet cleaning. Fluorochemical compounds have been described in the prior art as useful in treating textiles, such as carpets, to impart oil and water repellency and soil resistance. Although these compositions have found commercial success, there is a continuing need for alternative formulations offering an increased cleaning potential for a variety of stains, particularly oily stains. In formulating a new carpet cleaning composition, it is particularly challenging to impart a new property into an existing composition without destroying other worthwhile properties of the composition.

One problem encountered when carpet has been treated with a cleaning composition is that frequently the treated portion of the carpet becomes more sensitive to resoiling than the untreated position of the carpet. Consequently, the resoiling of the treated portion of the carpet occurs more quickly for "cleaned" carpet as opposed to untreated carpet. Another problem commonly associated with carpet cleaning compositions is that the carpet is left with a "sticky" residue such that the "softness" of the carpet deteriorates after cleaning. Additionally, other undesirable properties include damage to the carpet by spotting, color loss, or leaving an undesirable residue.

There remains a need for alternative cleaning compositions useful in removing a variety of spots, particularly oily type stains from carpet, and other textiles, without imparting undesirable properties.

SUMMARY OF THE INVENTION

The need discussed above has been satisfied with the discovery of an aqueous cleaning composition having a pH level falling within a range of from about 4 to about 9.5 comprising:

(a) from about 0.75% to about 1.15% by weight of sodium lauryl sulfate;

(b) from about 0.65% to about 0.85% by weight ethylene glycol monohexyl ether;

(c) from about 0.025% to about 0.17% by weight of a fluorinated surfactant selected from a mixture of (i) a perfluoropropionate of formula I as defined below and (ii) a perfluoroalkyl phosphate of formula II as defined below, the weight ratio of (i) to (ii) being from about 1:1 to about 1:2;

(d) from about 0.025% to about 0.05% by weight of a styrene maleic anhydride polymer; and (e) from about 0.3% to about 0.45% by weight of a chelating agent selected from the group consisting of diethylenetriaminepentaacetic acid, ethylenediaminetetraacetic acid, N-hydroxyethylethylenediaminetriacetic acid, sodium or potassium salts thereof, and mixtures thereof, wherein the weight percentages are based on the total active ingredient weight of the aqueous composition.

The inventive composition is stable and is particularly effective in removing a variety of stains from carpeting without contributing to undesirable properties commonly associated with carpet cleaning compositions. One particular group of stains that may be substantially removed from textiles using the inventive composition are oily stains. The inventive composition is useful in cleaning textiles as well as rugs and carpets. Additionally, prevention of resoiling and stain and dirt repellency are observed as attributes of the composition.

DETAILED DESCRIPTION OF THIS INVENTION

The sodium lauryl sulfate component is widely available commercially. Preferably it is employed in a range of 0.75% to 1.15% by weight, more preferably 0.8% to 1% by weight, and most preferably from 0.85% to 0.9% by weight % (active ingredient), with all weight percentages herein based on the total weight of the composition. The ethylene glycol monohexyl ether is also widely available and is preferably employed within a range of from about 0.65% to about 0.85% by weight, more preferably from 0.7% to 0.8% by weight, and most preferably about 0.75% by weight (active ingredient).

The fluorinated surfactant acts primarily as an anti-soiling and anti-staining agent and is a mixture of Formula I and II, where Formula I is:

$$F(CF_2)_n—CH_2CH_2—S—CH_2CH_2—COOLi \qquad \text{I}$$

wherein n is an integer having a value of 6 to 12 and may be identified as an α-{2-[(2-carboxyethyl)thio]ethyl}- ω-fluoro-poly-(difluoromethylene) lithium salt, and where Formula II is a diethanolamine salt of a perfluoroalkyl phosphate as represented by the general formula:

$$CF_3CF_2(CF_2CF_2)_n—CH_2CH_2—O—\overset{\overset{O^-}{|}}{\underset{\underset{O^-}{|}}{P}}=O \qquad \text{II}$$

MONO/BIS-DIETHANOLAMINE SALT wherein n is an integer having a value of 6 to 12. The weight-ratio of the perfluoropropionate of Formula I to the perfluoroalkyl phosphate of Formula II in the mixture is in the range of from about 1:1 to about 1:2, and the amount of the mixture employed in the composition is from about 0.025% to about 0.17% by weight, more preferably from 0.1% to 0.15% by weight, most preferably about 0.1% by weight (active ingredient). Such a mixture may be purchased from E. I. DuPont de Nemours & Co., Inc. under the chemical name ZONYL TM 7950. The composition also contains a carboxylated polymer salt, preferably a styrene maleic anhydride polymer, available commercially such as, for example, ZELAN TM 338, from E. I. DuPont de Nemours & Co., Inc. This ingredient is preferably employed in an amount from about 0.025% to about 0.05% by weight, and most preferably from 0.03% to 0.04% by weight (active ingredient).

The chelating agent(s) used are preferably aminopolycarboxylic acid compounds in which the amino nitrogen has attached thereto two or more substituent groups. Preferred are the acids and potassium or sodium salts of ethylenediaminetetraacetic acid (EDTA), diethylenetriaminepentaacetic acid (DTPA), and N-hydroxyethylethylenediaminetriacetic acid (HEDTA) and mixtures thereof. Most preferred is tetrasodium ethylenediaminetetraacetate ($Na_4EDTA$). Preferably the chelating agent is used in an amount ranging from about 0.3% to about 0.45% by weight, more preferably from 0.35% to 0.4% by weight, and most preferably from 0.37% to 0.39% by weight (active ingredient).

The compositions of the invention may include optional ingredients for performing specifically desired functions such as sequestrates, e.g., citric acid, sodium hexametaphosphate, and the like; organic liquid solvents for water-soluble stains, e.g., monohydric aliphatic alcohols having 1 to 6 carbon atoms; corrosion inhibitors, such as, citric acid, formaldehyde (formalin), sodium citrate, sodium nitrate, ammonia, and so on; preservatives, such as methyl- and ethylparaben, 1,2-benzoisothiazole-3(2H)-ones (including the preservative KATHON TM CG-ICP, available from Rohm and Haas).

The compositions of the invention are preferably formulated as aqueous solutions or emulsions and can be dispensed for use as liquids using conventional dispensing devices such as squeeze bottles fitted with a suitable dispensing nozzle or containers fitted with trigger spray pumps which are well known in the art.

The pH of the aqueous compositions of the invention preferably falls within a range of from about 4 to about 9.5, more preferably from 5 to 8, and most preferably between 6 and 7. If the composition requires an pH adjustment to fall within this range, known pH adjusting agents may be employed.

The composition may be prepared using conventional techniques known to those skilled in the art. The composition is a substantially clear liquid having the viscosity similar to that of water and may be stored as a stable liquid for extended periods.

Preferably, carpets are cleaned by applying the composition directly on the carpet, by spraying for example, followed by rubbing the sprayed area with a suitable device, such as, for example, a clean damp cloth or sponge mop, with rinsing of the device until the stain or soil is removed. Textiles may also be cleaned by the composition in a similar manner.

The composition of the invention is illustrated by the following examples of specific formulations without, however, being limited thereto.

EXAMPLES

Formulas A–C were prepared by techniques familiar to those skilled in the art using ingredients as shown in the Tables. Formulas A–C were each tested for stability for 6 weeks at room temperature, 105° F., 120° F. and 40° F. Additionally, the formulas were subjected to a freeze-thaw test for 3 cycles (thaw for 24 hours after freezing). All tests results for Formulas A–C showed the formulas as stable.

FORMULA A

| COMPONENT | WT % |
|---|---|
| Water | q.s. |
| Sodium lauryl sulfate[a] (29%) | 3 |
| Ethylene glycol monohexyl ether[b] | 0.75 |
| Isopropyl Alcohol | 2 |
| Fluorinated Surfactant (25%)[c] | 0.4 |
| Carboxylated Polymer Salt (25%)[d] | 0.15 |
| Tetrasodium ethylenediamine tetraacetate[e] (38%) | 1 |
| Fragrances | 0.2 |
| Preservative[f] | 0.05 |
| Citric Acid | 0.11 |
| pH = >6.5 | |

[a] RHODAPON TM LCP-manufactured by Rhome-Poulenc, Inc., active ingredient 0.87 wt. %.

[b] HEXYL CELLOSOLVE TM - manufactured by Union Carbide Company.

[c] ZONYL TM 7950, a 10–15% mixture of a perfluoropropionate of Formula I herein; 15–20% of a mixture of perfluoroalkyl phosphates of Formula II herein (the perfluoroalkyl phosphate salts are obtained by neutralization of the corresponding acid with diethanolamine); 5–10% trichlorotrifluoroethane; 25–30% isopropyl alcohol; 35–40% water - manufactured by E. I. DuPont de Nemours Co., Inc., active ingredient 0.1 wt. %.

[d] ZELAN TM 338, a styrene maleic anhydride polymer - manufactured by E. I. DuPont de Nemours Co., Inc., active ingredient 0.0375 wt. %.

[e] Active Ingredient 0.38 wt. %.

[f] KATHAN TM CG-ICP, active ingredient 0.00075 wt. %.

FORMULA B

| COMPONENT | WT % |
|---|---|
| Water D.I. | q.s. |
| Sodium lauryl sulfate (29%)[a] | 3 |
| Ethylene glycol monohexyl ether[b] | 0.75 |
| Isopropyl Alcohol | 2 |
| Fluorinated Surfactant (25%)[c] | 0.5 |
| Carboxylated Polymer Salt (25%)[d] | 0.3 |
| Tetrasodium ethylenediamine tetraacetate[e] (38%) | 1 |
| Fragrance | 0.2 |
| Preservative[f] | 0.08 |
| Citric Acid | 0.12 |
| pH = >6.5 | |

[a] RHODAPON TM LCP-manufactured by Rhome-Poulenc, Inc., active ingredient 0.87 wt. %.

[b] HEXYL CELLOSOLVE TM - manufactured by Union Carbide Company.

[c] ZONYL TM 7950, a 10–15% mixture of a perfluoropropionate of Formula I herein; 15–20% of a mixture of perfluoroalkyl phosphates of Formula II herein (the perfluoroalkyl phosphate salts are obtained by neutralization of the corresponding acid with diethanolamine); 5–10% trichlorotrifluoroethane; 25–30% isopropyl alcohol; 35–40% water - manufactured by E. I. DuPont de Nemours Co., Inc., active ingredient 0.125 wt. %.

[d] ZELAN TM 338, a styrene maleic anhydride polymer - manufactured by E. I. DuPont de Nemours Co., Inc., active ingredient 0.075 wt. %.

[e] Active Ingredient 0.38 wt. %.

[f] KATHAN TM CG-ICP, active ingredient 0.0012 wt. %.

FORMULA C

| COMPONENT | WT % |
|---|---|
| Water D.I. | q.s. |
| Sodium lauryl sulfate (29%)[a] | 3 |
| Ethylene glycol monohexyl ether[b] | 0.75 |
| Isopropyl Alcohol | 2 |
| Fluorinated Surfactant (25%)[c] | 0.5 |
| Carboxylated Polymer Salt (25%)[d] | 0.15 |
| Tetrasodium ethylenediamine tetraacetate[e] (38%) | 1 |
| Fragrance | 0.2 |
| Preservative[f] | 0.08 |
| Citric Acid | 0.11 |

-continued

| FORMULA C | |
|---|---|
| COMPONENT | WT % |
| pH = ≈6.5 | |

[a]RHODAPON TM LCP-manufactured by Rhome-Poulenc, Inc., active ingredient 0.87 wt. %.
[b]HEXYL CELLOSOLVE TM - manufactured by Union Carbide Company.
[c]ZONYL TM 7950, a 10–15% mixture of a perfluoropropionate of Formula I herein; 15–20% of a mixture of perfluoroalkyl phosphates of Formula II herein (the perfluoroalkyl phosphate salts are obtained by neutralization of the corresponding acid with diethanolamine); 5–10% trichlorotrifluoroethane; 25–30% isopropyl alcohol; 35–40% water - manufactured by E. I. DuPont de Nemours Co., Inc., active ingredient 0.125 wt. %.
[d]ZELAN TM 338, a styrene maleic anhydride polymer - manufactured by E. I. DuPont de Nemours Co., Inc., active ingredient 0.0375 wt. %.
[e]Active Ingredient 0.38 wt. %.
[f]KATHAN TM CG-ICP, active ingredient 0.0012 wt. %.

TABLE A

| Test Carpets |
|---|
| DuPont STAINMASTER TM CHAMPLIN Almond |
| DuPont STAINMASTER CHAMPLIN Ocean Blue |
| DuPont STAINMASTER CHAMPLIN Embers |
| DuPont STAINMASTER CHAMPLIN Golf Green |
| Philadelphia MAINSTREET TM Cottonseed |
| Philadelphia MAINSTREET Imperial Red |
| Philadelphia MAINSTREET Smoked Blue |
| Philadelphia MAINSTREET Laguna Green |
| Etoil Wool Geranium |
| Etoil Wool Elegan |
| Lees Polyester Parchment |
| Lees Polyester Bordeaux |
| Lees Polyester Sapphire |

EXAMPLE 1

The effect of Formula A on the color and overall appearance of each of the carpets listed in Table A was conducted.

Samples of the carpets were cut in 12"×12" pieces. For the control, each sample of carpet was sprayed with 25 g of distilled water and then wiped 25 cycles with a white washcloth. For the testing of Formula A, 25 g of Formula A was sprayed on each sample of carpet, and then the carpet was wiped with a white washcloth for 25 cycles. All carpet samples were then allowed to dry followed by vacuuming. This procedure was repeated four times.

Twenty-one panelists were selected and the control carpet samples and the carpet samples cleaned with Formula A were shown to them. The panelists were instructed that all samples (both the controls and the carpet cleaned with Formula A) had been treated with a carpet cleaner. They were then asked if treatment with the "cleaners" (i.e. water or Formula A) had damaged the carpets.

Table I illustrates the panel results. Out of 21 people paneled, the number of people who gave a response 'yes' to the question on whether the carpet appeared damaged. As employed throughout the examples, when the data is analyzed using the "Chi Square method" (as described in *Statistical Analysis* (2nd Edition) by Samuel B. Richmond, The Ronald Press Co., New York, 1964, p. 290–303) at a 95% confidence level, 15 panelists for each product tested per carpet would have had to give a 'yes' response for there to be any significance between the products tested. As shown by the data, at most only one panelist saw a difference with the carpet cleaned by Formula A.

The carpet samples cleaned with Formula A were also compared to virgin pieces of the same carpet using a Minolta CHROMOMETER TM Model C-R 110 reflectometer. Table II illustrates the reflectometer readings taken. Δ E represents the difference in reflected light between the carpets cleaned with product, and a virgin piece of the same carpet. This value has been corrected for any carpet fiber change by rubbing. A Δ E value less than 2.0 is usually undetected by the human eye.

TABLE I

Panel Results
25 Panelists Instructed: These carpets have been treated with a carpet cleaner. After treatment with these cleaners, are these carpets damaged? Yes or No.
# of Yes Responses out of 21 Panelists

| Carpet | Water Washed | Formula A |
|---|---|---|
| DuPont: | | |
| STAINMASTER CHAMPLIN Almond | 0 | 0 |
| STAINMASTER CHAMPLIN Ocean Blue | 1 | 0 |
| STAINMASTER CHAMPLIN Embers | 2 | 0 |
| STAINMASTER CHAMPLIN Golf Green | 0 | 0 |
| Philadelphia: | | |
| MAINSTREET Cotton Seed | 0 | 0 |
| MAINSTREET Imperial Red | 0 | 0 |
| MAINSTREET Smoked Blue | 0 | 0 |
| MAINSTREET Laguna Green | 0 | 0 |
| Etoil: | | |
| Wool Geranium | 0 | 0 |
| Wool Elegan | 0 | 0 |
| Lees: | | |
| Polyester Parchment | 0 | 0 |
| Polyester Bordeaux | 0 | 1 |
| Polyester Sapphire | 0 | 0 |

TABLE II

Reflectometer Results

| Carpet | Δ E Formula A |
|---|---|
| DuPont: | |
| STAINMASTER CHAMPLIN Almond | −1.57 |
| STAINMASTER CHAMPLIN Ocean Blue | 0.69 |
| STAINMASTER CHAMPLIN Embers | −2.30 |
| STAINMASTER CHAMPLIN Golf Green | −0.17 |
| Philadelphia: | |
| MAINSTREET Cotton Seed | −0.24 |
| MAINSTREET Imperial Red | −1.47 |
| MAINSTREET Smoked Blue | 0.02 |
| MAINSTREET Laguna Green | −2.58 |
| Etoil: | |
| Wool Geranium | 0.97 |
| Wool Elegan | 2.14 |
| Lees: | |
| Polyester Parchment | 0.29 |
| Polyester Bordeaux | 0.69 |
| Polyester Sapphire* | — |

*Reflectometer readings could not be done on this color because it is out of range (too dark).

EXAMPLE 2

The removal of feline malodor with Formula A was tested as follows. Two Philadelphia: MAINSTREET Cotton Seed carpet samples were stained with 2 g of cat urine obtained by Buckshire Labs, Perkosie, Pa. One carpet sample was left as the control. One of the carpet samples was then cleaned with 25 g of Formula A by spraying the composition on the carpet and then allowing it to set for 10 minutes. The carpet cleaned was then blotted with white paper towel until the visual stain was gone. The carpet was then dried overnight and subjected to fifteen (15) panelists thereafter. The panel was asked the question: "Is the pet stain removed? "The fifteen (15) panelists responded 'yes' the stain was removed, providing a 95% confidence level (using the Chi-Square method).

EXAMPLE 4

A twelve (12) key stain test was conducted using the test carpets Philadelphia MAINSTREET: Cotton Seed and STAINMASTER CHAMPLAIN: Almond. Formulas A, B and C were tested. For each Formula, twenty-four (24) strips of each type of carpet were treated. Two carpet strips were prepared for each stain. Lipstick, crayon and ink were drawn on individual strips of carpeting in the shape of an "X". Grape juice, wine and coffee (5 g each) were tipped via beaker on individual strips of carpeting. Tomato sauce, chocolate and salad dressing (1 gram); motor oil and mustard (0.40 grams); and liquid make-up (0.30 grams) were applied using a spatula and 2"×2" square template on individual strips. One set of stains were left for 30 minutes and the other set for 7 days. Stains were cleaned with 6 grams of the appropriate formula using white washcloths and 50 strokes. This procedure was repeated for each of the Formulas A, B and C.

After drying, thirty (30) panelists were asked to rate the carpets using the following scale:

Scale

1—No removal
2—Slight removal
3—Moderate removal
4—Almost complete removal
5—Complete removal

| | Results: | | |
|---|---|---|---|
| | Formula A | Formula B | Formula C |
| | 30 Minute Stains Philadeliphia Untreated | | |
| Lipstick | 2.92 | 2.95 | 2.63 |
| Crayon | 4.86 | 4.83 | 4.83 |
| Ink | 3.59 | 3.92 | 3.98 |
| Make-Up | 3.48 | 3.62 | 3.78 |
| Tomato Sauce | 4.90 | 4.85 | 4.88 |
| Salad Dressing | 4.15 | 4.08 | 4.05 |
| Motor Oil | 3.77 | 3.33 | 3.75 |
| Mustard | 2.98 | 2.73 | 2.70 |
| Chocolate | 4.18 | 3.38 | 4.05 |
| Grape Juice | 4.22 | 4.07 | 4.10 |
| Red Wine | 3.78 | 3.65 | 3.66 |
| Coffee | 4.08 | 4.27 | 4.43 |
| | 30 Minute Stains STAINMASTER | | |
| Lipstick | 3.80 | 3.62 | 3.42 |
| Crayon | 4.98 | 4.88 | 4.98 |
| Ink | 2.83 | 3.03 | 2.90 |
| Make-Up | 3.53 | 3.45 | 3.37 |
| Tomato Sauce | 4.96 | 4.98 | 4.96 |
| Salad Dressing | 4.95 | 4.85 | 4.80 |
| Motor Oil | 4.98 | 4.33 | 4.54 |
| Mustard | 2.95 | 3.25 | 3.13 |
| Chocolate | 3.52 | 3.35 | 3.50 |
| Grape Juice | 3.65 | 3.48 | 3.27 |
| Red Wine | 3.20 | 2.85 | 3.07 |
| Coffee | 3.07 | 2.87 | 3.37 |
| | 7 Day Stains Philadelphia Untreated | | |
| Lipstick | 3.80 | 3.62 | 3.42 |
| Crayon | 4.98 | 4.88 | 4.98 |
| Ink | 2.83 | 3.03 | 2.90 |
| Make-Up | 3.53 | 3.45 | 3.37 |
| Tomato Sauce | 4.96 | 4.98 | 4.96 |
| Salad Dressing | 4.95 | 4.85 | 4.80 |

-continued

| | Results: | | |
|---|---|---|---|
| | Formula A | Formula B | Formula C |
| Motor Oil | 4.98 | 4.33 | 4.54 |
| Mustard | 2.95 | 3.25 | 3.13 |
| Chocolate | 3.52 | 3.35 | 3.50 |
| Grape Juice | 3.65 | 3.48 | 3.27 |
| Red Wine | 3.20 | 2.85 | 3.07 |
| Coffee | 3.07 | 2.87 | 3.37 |
| | 7 Day Stains STAINMASTER | | |
| Lipstick | 3.05 | 3.38 | 3.45 |
| Crayon | 4.90 | 4.83 | 4.87 |
| Ink | 3.72 | 3.58 | 3.23 |
| Make-Up | 3.83 | 3.63 | 3.88 |
| Tomato Sauce | 4.66 | 4.59 | 4.71 |
| Salad Dressing | 4.73 | 4.77 | 4.62 |
| Motor Oil | 4.59 | 4.27 | 4.03 |
| Mustard | 3.83 | 4.07 | 3.89 |
| Chocolate | 3.33 | 2.90 | 2.73 |
| Grape Juice | 3.64 | 3.23 | 3.45 |
| Red Wine | 3.25 | 3.13 | 3.12 |
| Coffee | 3.15 | 3.15 | 3.07 |

EXAMPLE 5

DuPont STAINMASTER Nylon (Color: Ocean Blue), Etoil Wool (Color: Elegan), Lees Polyester (Color: Sapphire) were tested to determine whether treatment of the carpets with Formula A left the carpet soft (desirable) or sticky (undesirable).

Each of the carpets were cut into 12"×12" pieces. Each carpet piece was treated with 16.6 grams of Formula A and rubbed into the carpet with white paper towel for approximately 50 strokes. The carpets were then allowed to dry overnight. Twenty (20) people were paneled, asking them the following question: "Is the carpet soft, not sticky?"

Table III illustrates the panel results. The table shows out of twenty (20) people paneled, how many gave a response of 'yes' to the question asked.

TABLE III

Averaged Panel Results
Panelist Response to Question "Is the carpet soft, not sticky?"

| Carpet | # of yes Responses | # of No Responses |
|---|---|---|
| Nylon | 20 | 0 |
| Wool | 19 | 1 |
| Polyester | 19 | 1 |

EXAMPLE 6

Resoiling was tested on carpeting that was cleaned with Formula A. Carpets tested were DuPont STAINMASTER CHAMPLIN: Almond and Philadelphia MAINSTREET: Cotton Seed. The test procedure involved a 1"×3" section of carpet (for each carpet tested). One portion of the section was used as a control. For the test, 50 grams of Formula A was sprayed on the other portion of the carpet. The product was then wiped into the carpet using clean, white absorbent cloth in the designated section, then allowed to dry. The carpet piece was then placed in hallway, rotating 180° every week, until the carpet was visually dirty. The carpet piece was then removed from hallway and vacuumed. Reflectometer readings were taken of the sections, comparing the portion cleaned with Formula A to the virgin carpet to see if Formula A resoiled more quickly than the untreated Control portion. Both types of carpets were then visually paneled by thirty (30) people using the following scale:

Scale

1=very soiled
5=slightly soiled

Visual Panel Results are shown in Table IV below.

TABLE IV

| Visual Panel DuPont STAINMASTER Carpet Scale: 1 = very soiled 5 = slightly soiled | | |
|---|---|---|
| 30 PANELISTS | CONTROL | FORMULA A |
| Average | 4.35 | 3.95 |

The results indicate that Formula A did not contribute to resoiling but rather provided a soil repellant effect to the carpet.

Reflectometer readings were also taken of the carpet sections, with results summarized in Table V below.

TABLE V

| | Reflectometer Readings Δ E Values | |
|---|---|---|
| | DuPont STAINMASTER | Philadelphia MAINSTREET |
| Control | 6.18 | 3.16 |
| Formula A | 5.27 | 2.02 |

*The greater the Δ E, the dirtier the carpet section.
**Δ E values less than 2.0 are usually undetected by the human eye.

The invention has been described above with particular reference to preferred embodiments. A skilled practitioner familiar with the above-detailed description can make many modifications and substitutions without departing from the scope and spirit of the invention.

That which is claimed is:

1. An aqueous cleaning composition having a pH level falling within a range of from about 4 to about 9.5 comprising:

(a) from about 0.75% to about 1.15% by weight of sodium lauryl sulfate;

(b) from about 0.65% to about 0.85% by weight ethylene glycol monohexyl ether;

(c) from about 0.025% to about 0.17% by weight of a fluorinated surfactant selected from a mixture of (i) a perfluoropropionate of the Formula I $$F(CF_2)_n—CH_2CH_2—S—CH_2CH_2—COOLi \quad \text{I}$$

wherein n is an integer having a value of 6 to 12; and (ii) a perfluoroalkyl phosphate of formula II $$CF_3CF_2(CF_2CF_2)_n—CH_2CH_2—O—\overset{\overset{O^-}{|}}{\underset{\underset{O^-}{|}}{P}}=O \quad \text{II}$$

MONO/BIS-DIETHANOLAMINE SALT wherein n is an integer having a value of 6 to 12; and the weight ratio of (i) to (ii) being from about 1:1 to about 1:2;

(d) from about 0.025% to about 0.05% by weight of a styrene maleic anhydride polymer; and wherein the weight ratio of (c) to (d) is about 2.7:1; and (e) from about 0.3% to about 0.45% by weight of a chelating agent selected from the group consisting of diethylenetriaminepentaacetic acid, ethylenediaminetetraacetic acid, N-hydroxyethylethylenediaminetriacetic acid, sodium or potassium salts thereof, and mixtures thereof, wherein said weight percentages are based on the total active ingredient weight of the aqueous composition.

2. A composition according to claim 1 wherein said chelating agent is sodium ethylenediaminetetraacetate.

3. A composition according to claim 2 wherein (a) is present in a range from 0.8% to 1% by weight.

4. A composition according to claim 1 wherein (c) is present in a range from 0.1% to 0.15% by weight.

5. A composition according to claim 4 wherein (d) is present in a range from 0.03% to 0.04% by weight.

6. A composition according to claim 1 wherein (a) is present in an amount from 0.85% to 0.9% by weight.

7. A composition according to claim 6 wherein (b) is present in an amount of about 0.75% by weight.

8. A composition according to claim 7 wherein (c) is present in an amount of about 0.1% by weight.

9. A composition according to claim 8 wherein (d) is present in an amount of 0.03% to 0.04% by weight and (e) is present in an amount of 0.37% to 0.39% by weight.

10. A composition according to claim 9 wherein said pH is between 6 and 7.

11. A method of cleaning a rug, carpet or textile by using as a cleaning agent an aqueous cleaning composition having a pH level of about 4 to about 9.5 comprising:

(a) from about 0.75% to about 1.15% by weight of sodium lauryl sulfate;

(b) from about 0.65% to about 0.85% by weight ethylene glycol monohexyl ether;

(c) from about 0.025% to about 0.17% by weight of a fluorinated surfactant selected from a mixture of (i) a perfluoropropionate of the Formula I $$F(CF_2)_n—CH_2CH_2—S—CH_2CH_2—COOLi \quad \text{I}$$

wherein n is an integer having a value of 6 to 12; and (ii) a perfluoroalkyl phosphate of formula II $$CF_3CF_2(CF_2CF_2)_n—CH_2CH_2—O—\overset{\overset{O^-}{|}}{\underset{\underset{O^-}{|}}{P}}=O \quad \text{II}$$

MONO/BIS-DIETHANOLAMINE SALT wherein n is an integer having a value of 6 to 12; and the weight ratio of (i) to (ii) being from about 1:1 to about 1:2;

(d) from about 0.025% to about 0.05% by weight of a styrene maleic anhydride polymer; and wherein the weight ratio of (c) to (d) is about 2.7:1; and (e) from about 0.3% to about 0.45% by weight of a chelating agent selected from the group consisting of diethylenetriaminepentaacetic acid, ethylenediaminetetraacetic acid, N-hydroxyethylethylenediaminetriacetic acid, sodium or potassium salts thereof, and mixtures thereof, wherein said weight percentages are based on the total active ingredient weight of the aqueous composition wherein said cleaning agent is applied directly to said rug, carpet or textile.

* * * * *